United States Patent [101]

Clark

[11] 4,045,831

[45] Sept. 6, 1977

[54] BED SHEET

[76] Inventor: William F. Clark, Apt. 202, 49051 Denton Road, Belleville, Mich. 48111

[21] Appl. No.: 614,344

[22] Filed: Sept. 17, 1975

[51] Int. Cl.[2] ..... A47G 9/00

[52] U.S. Cl. ..... 5/334 R; 5/334 C

[58] Field of Search ..... 5/334 R, 334 C, 335, 5/336

[56] References Cited

U.S. PATENT DOCUMENTS

| | | | |
|---|---|---|---|
| 1,409,961 | 5/1922 | McKinny | 5/335 |
| 2,942,280 | 6/1960 | May | 5/334 C |
| 3,380,086 | 4/1968 | McCurry | 5/334 R |

*Primary Examiner*—Paul R. Gilliam
*Assistant Examiner*—A. M. Calvert
*Attorney, Agent, or Firm*—Kevin R. Peterson

[57] ABSTRACT

An improved bed sheet which can be used both as a bottom and top sheet. The bed sheet has a fabric panel sized to fit the mattress with which it is to be used. Open pockets at each end of the bed sheet serve to enclose the head and foot portions of a mattress when used as a bottom sheet. When used as a top sheet, one pocket is used to enclose the foot portion of a mattress while the second pocket is used to hold the edge of a blanket from contact with a person while sleeping.

1 Claim, 4 Drawing Figures

BED SHEET

BACKGROUND OF THE INVENTION

It is the usual practice in hotels and motels to change the sheets on a bed each day. Any blankets used on the bed are returned to the bed without cleaning. Each guest using the bed is then exposed to contamination from portions of the blanket which had been in contact with prior guests.

It is customary in making a bed to fold back the end of the upper sheet to cover the edge of the blanket. The blanket covering provided by the sheet is usually only temporary as the movement of the sleeping person is more times than not sufficient to expose the blanket to contact. The improved bed sheet of the present invention provides a pocket into which the edge of the blanket is placed. The pocket is deep enough to prevent the blanket from working loose during the night. The sleeping person is thereby protected from contact with previously used blankets and is provided with a more sanitary bed in which to sleep.

The most common sheet configuration in use on beds today is the use of a fitted sheet to cover the mattress, with a flat sheet used as an upper sheet. Fitted sheets usually have an elastic strip at each corner or a single continuous strip surrounding the open edge of the sheet. The elastic strips tend to cause the sheets to be bulky when stored. Also, the elastic is subject to breaking, both from being stretched in use and due to degredation from frequent exposure to hot soapy water. Once the elastic breaks, the sheet is no longer suitable for use.

Fitted sheets using elastic are also expensive to manufacture in view of the labor required to attach the elastic to the sheeting.

The bed sheet of the present invention uses no elastic and can be laid out, cut, and sewn using automatic equipment, thereby substantially reducing the cost of manufacture. The sheet can be folded into a flat compact form since no elastic is used, thereby saving storage space, and simplifying usage. Since only one type of sheet is used for both the top and bottom, problems in both storage and use are eliminated. The hotel or motel need only buy one type of sheet. Also, the maids no longer have to be concerned with having an equal number of fitted and flat sheets. By using the sheets of the present invention, the maid has to merely take two sheets for each bed without being concerned whether they are fitted or flat.

Figure 1:
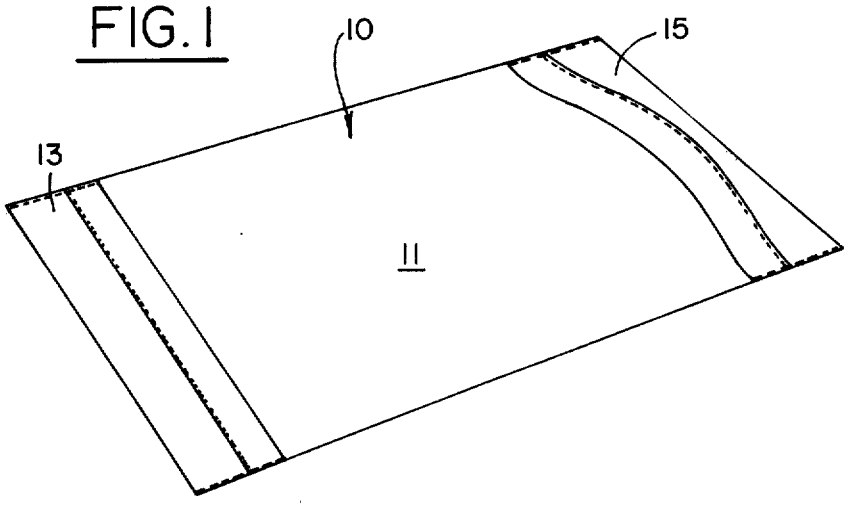
FIG. 1 is a perspective view of the sheet of the present invention showing one pocket partially opened.

Referring to FIG. 1, the sheet of the present invention is referred to generally by the number 10. The sheet 10 can be made from any of the conventional bed sheeting materials, for example, cotton, cotton percale, muslin, linen, etc. The sheet 10 has a panel 11 which is preferably sized in length to cover the upper surface of a mattress. The panel 11 is preferably made wide enough to overlap the edges of a matress so that the edge portions of the sheet can be tucked under a mattress to hold the edge portions of the sheet in place. At what would correspond to the head and foot portions of the sheet 10, pockets 13 and 15 are found. The pockets 13 and 15 extend across the width of the sheet 10 and are preferably made by folding back portions of the fabric panel 11 and sewing the edges of the overlapped portions to the edges of the fabric panel. The selvage and any trim to be added to the sheet can be added before or after the pockets are formed. As shown in FIG. 1, since a single sheet can be used for both the bottom and top and since the head and foot portions of the sheet are the same, the trim along the open edges of pockets 13 and 15 should be the same width.

The pockets 13 and 15 are preferably made by folding back opposite edge portions of the fabric panel 11. The edges are folded back approximately one-third to one-fifth the length of the panel 11. The length or depth of the pocket should be sufficient to hold a blanket from easily working loose due to the movement of a sleeping person. Also, the pocket should be deep enough to enclose the head and foot portions of an associated mattress. Bearing in mind that the dimensions of so-called standard size mattresses vary slightly depending on the manufacturer.

The pockets 13 and 15 could also be made by sewing separate short lengths of fabric to each end of the panel 11. This method of manufacture is not preferred in view of the separate sewing operation required.

Figure 2:
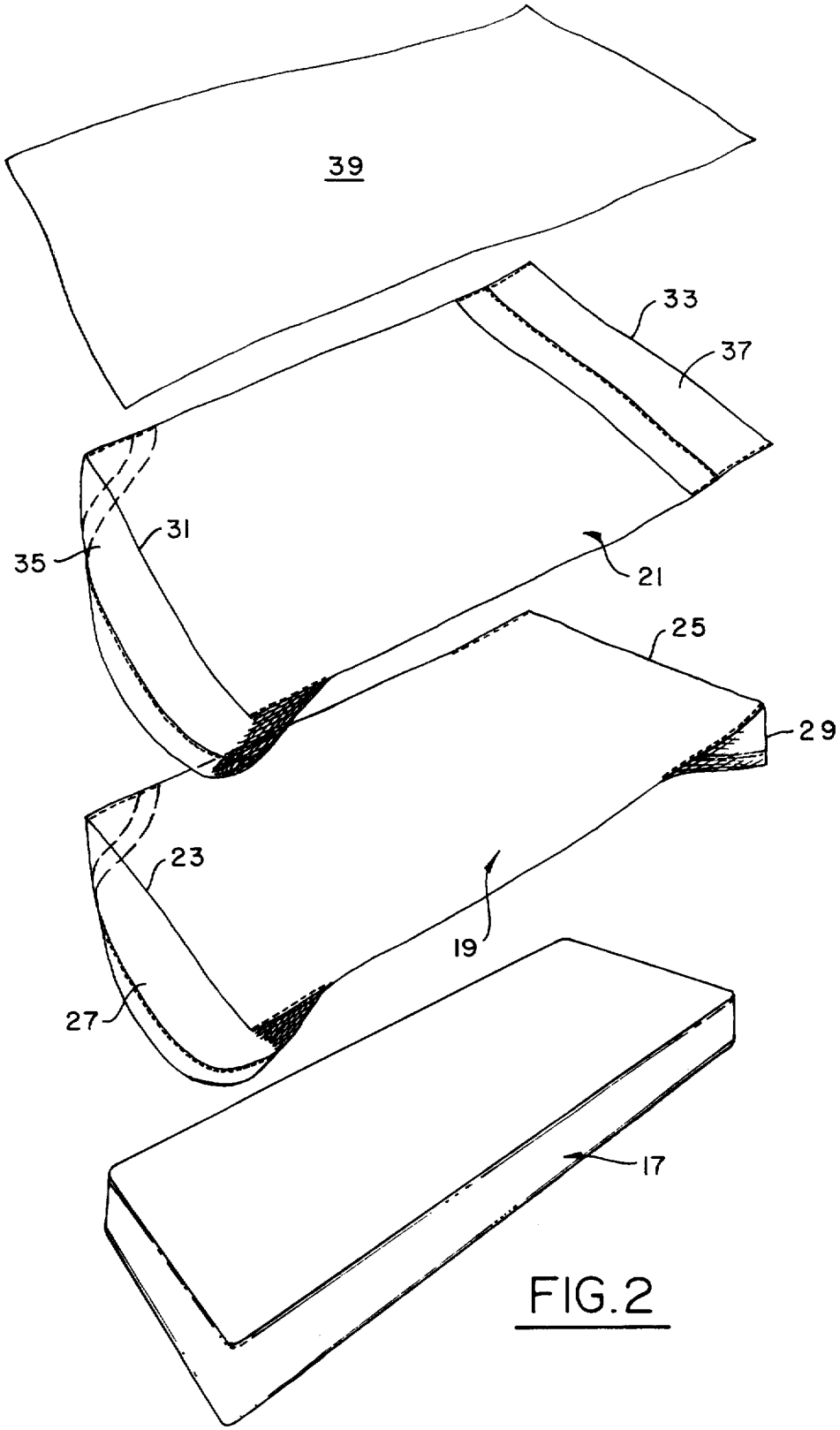
FIG. 2 is an exploded view of a mattress, a top and bottom sheet of the present invention, illustrating how the pockets are turned out, and a blanket.

Referring now to FIG. 2, a mattress 17 is shown which is to be covered with two sheets of the present invention and a blanket. The mattress can be any size, for example, twin, double, queen, king, etc. The thickness of the mattress is also immaterial since the sheet of the present invention is adapted to fit mattresses of different thicknesses.

The bottom sheet 19 and top sheet 21, which are to be used on mattress 17, are preferably dimensioned to be the same length as the top surface of the mattress. In making a bed, the bottom sheet 19 is placed on the mattress 17 and the edges 23 and 25 are aligned with the edges of the mattress. The head and foot pockets 27 and 29, respectively, of the sheet 19 are then turned out and back to enclose the head and foot portions of the mattress. The side portions of the sheet are tucked under the edges of the mattress to form a tight and smooth covering over the mattress. By tucking the sides of the sheet under the mattress and over the portions of the mattress already enclosed by the pockets, tight fitting corners are formed which are substantially identical to so-caled "hospital corners." The sheet is, in effect, fitted to the mattress without the strain produced by the conventional elastic member.

After the bottom sheet is tightly in place, the upper sheet 21 is then placed over the mattress. The edges of 31 and 33 are aligned with the edges of the head and foot portions of the mattress 17. The foot pocket 35 of the sheet 21 is then turned out to enclose the foot portion of the mattress 17 already covered by sheet 19. If desired, the edges of the sheet near the foot corner can be tucked under the mattress forming tight corners as was done with sheet 19. It is also possible to wait until a blanket is on the sheet and then tuck edges of the sheet and blanket under the mattress 17 simultaneously.

The pocket 37 at the head portion of the sheet 21 is not folded over the end of the mattress but is left ready to receive blanket 39. The blanket 39 is placed over sheet 21 and aligned with mattress 17. The head portion of the blanket is placed within pocket 37 and smoothed out to preferably align the upper edge of the blanket with edge 33 of sheet 21. The corner of blanket 39 should preferably fill out the corner of pocket 37. The foot and edge portions of blanket 39 can now be folded and tucked under mattress 17 to finish. Obviously, one or more blankets can be used in a similar manner as well as pillows and a bedspread to complete making up the bed.

Figure 3:
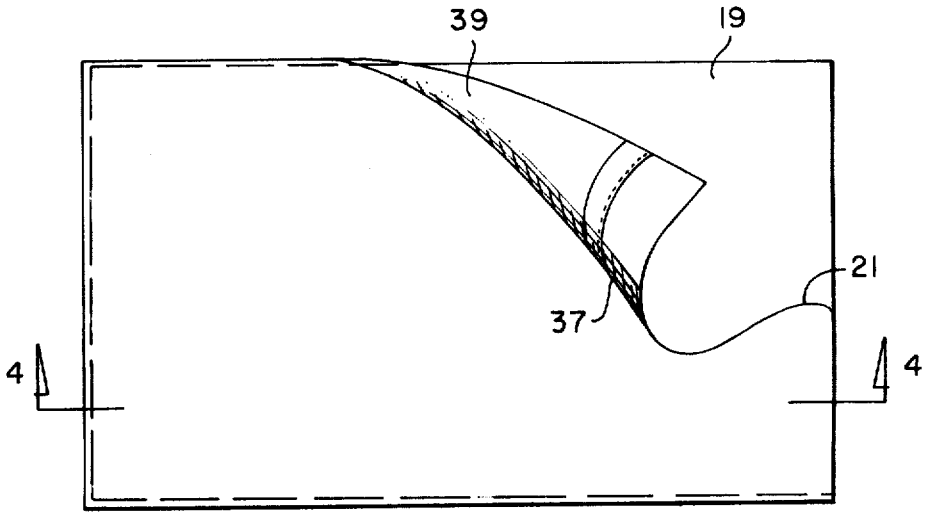
FIG. 3 is a plan view of the bed made up according to FIG. 2 with one corner of the blanket and top sheet shown folded back.
Figure 4:
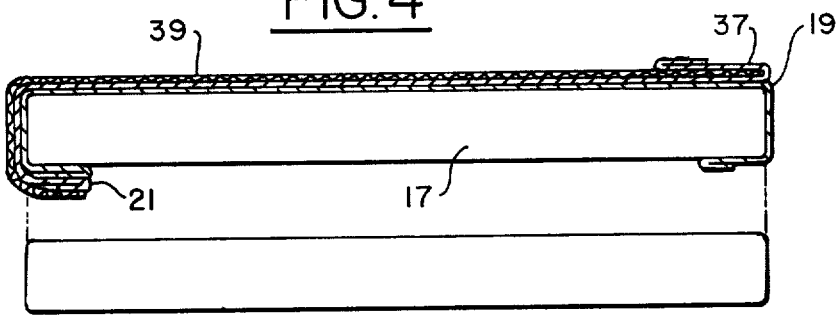
FIG. 4 is a sectional view of the bed of FIG. 3 taken in the direction of the line 4—4.

Referring to FIG. 3, the blanket 39 is shown partially folded back with its corner held within a corner of pocket 37 of sheet 21. The pocket is deep enough to hold the blanket edge so that it cannot easily work out, thereby providing a more sanitary bed. Also, as shown in FIG. 4, the pockets are deep enough to enclose the head and foot portions of the mattress 17.

The inventive sheet of the present invention can be easily made using automatic cutting, folding, and sewing equipment of the types conventionally used. In use, only one type of sheet is used for both the bottom and top sheets and since the sheet is preferably dimensioned in length to fit the associated mattress, the head and foot edges help the person making a bed to align and proportion the sheet to the mattress, thereby facilitating the making of the bed.

The sheet provides a sanitary lock for the blanket, keeping it from contacting the skin of a sleeping person. For even more protection, a means can be provided on the pocket to fasten to the blanket to hold the edge of the pocket to the blanket. This and any other addition or modification to fit particular circumstances are all contemplated within the scope of the present invention.

It will be apparent that many changes and modifications of the several features described herein may be made without departing from the spirit and scope of the invention. It is, therefore, apparent that the foregoing description is by way of illustration of the invention rather than limitation of the invention.

What is claimed is:

1. An improved bedsheet for covering a mattress comprising:

a fabric panel which is substantially the same length as said mattress, substantially the same width as the blanket to be used with said sheet and substantially wider than said mattress, a pair of facing, open pockets at opposite ends of said fabric panel, each of said pockets being deep and wide enough to receive an end of the flattened blanket to be used with said sheet, one of said pockets being capable of being adapted to enclose the foot portion of said mattress and the other of said pockets being capable of receiving and enclosing the head portion of said blanket such that movement of a sleeping person is insufficient to pull the blanket out of the pocket thereby preventing said person from coming into contact with the blanket.

* * * * *